US009651270B2

(12) United States Patent
Muenzberg et al.

(10) Patent No.: US 9,651,270 B2
(45) Date of Patent: May 16, 2017

(54) HYDRAULIC DEVICE AND EVAPORATIVE SYSTEM WITH SUCH A HYDRAULIC DEVICE

(71) Applicant: Condair Technologie Und Innovation AG, Pfaeffikon (CH)

(72) Inventors: Gerhard Muenzberg, Obstalden (CH); Patrick Blaser, Brunnen (CH); Neal Hiscock, Littlehampton (GB); Michael Gaunt, Brighton (GB); Nathaneal Wheeler, Portsmouth (GB)

(73) Assignee: Condair Group AG, Pfaeffikon (CH)

( * ) Notice: Subject to any disclaimer, the term of this patent is extended or adjusted under 35 U.S.C. 154(b) by 50 days.

(21) Appl. No.: 14/432,625

(22) PCT Filed: Jul. 5, 2013

(86) PCT No.: PCT/CH2013/000119
§ 371 (c)(1),
(2) Date: Mar. 31, 2015

(87) PCT Pub. No.: WO2014/056116
PCT Pub. Date: Apr. 17, 2014

(65) Prior Publication Data

US 2015/0260419 A1 Sep. 17, 2015

(30) Foreign Application Priority Data

Oct. 8, 2012 (EP) ..... 12006951

(51) Int. Cl.
*B01F 3/04* (2006.01)
*F24F 6/04* (2006.01)
(Continued)

(52) U.S. Cl.
CPC ..... *F24F 3/1405* (2013.01); *B01F 3/04085* (2013.01); *F24F 3/147* (2013.01); *F24F 5/0035* (2013.01); *F24F 6/04* (2013.01)

(58) Field of Classification Search
CPC .... B01F 3/04; B01F 3/04021; B01F 3/04085; F24F 6/14
(Continued)

(56) References Cited

U.S. PATENT DOCUMENTS 5,948,324 A * 9/1999 Cook ..... F23D 14/68 261/106
6,112,538 A 9/2000 Strussion
(Continued)

FOREIGN PATENT DOCUMENTS

EP 1577617 9/2005
EP 2206980 7/2010
(Continued)

OTHER PUBLICATIONS

International Search Report No. PCT/CH2013/000119, dated Sep. 20, 2013, completed on Sep. 12, 2013.
(Continued)

*Primary Examiner* — Robert A Hopkins
(74) *Attorney, Agent, or Firm* — Cooper & Dunham LLP

(57) ABSTRACT

The invention relates to a hydraulic device (15; 55) for an evaporative system (11), comprising at least one pump (22; 62) and a housing (16; 56) with a water inlet (17; 57) and one or more water outlets (19; 59), wherein the at least one pump (22; 62) is mounted on the housing (16; 56) and a water tank (20; 60) is provided by the housing (16; 56), the water tank (20; 60) being arranged between the water inlet (17; 57) and the one or more water outlets (19; 59), wherein the at least one pump is provided for pumping water through the one or more water outlets. The invention furthermore relates to an
(Continued)

evaporative system (11) with such a hydraulic device (15; 55).

14 Claims, 14 Drawing Sheets

(51) Int. Cl.
*F24F 3/14* (2006.01)
*F24F 3/147* (2006.01)
*F24F 5/00* (2006.01)

(58) Field of Classification Search
USPC ..... 96/290, 294; 261/30, 98, 118
See application file for complete search history.

(56) References Cited

U.S. PATENT DOCUMENTS

| | | | |
|---|---|---|---|
| 6,237,896 | B1 | 5/2001 | Hicks et al. |
| 2010/0281896 | A1 | 11/2010 | Al Watban |

FOREIGN PATENT DOCUMENTS

| | | |
|---|---|---|
| JP | 57104036 | 6/1982 |
| JP | 04136641 | 5/1992 |
| JP | 08247509 | 9/1996 |
| JP | 2001314723 | 11/2001 |
| JP | 2009228935 | 10/2009 |

OTHER PUBLICATIONS

Notice of Reasons for Refusal issued by the Japanese Patent Office on Dec. 20, 2016 in connection with JP Pat. Appl. No. 2015-535945.

* cited by examiner

State of the art

HYDRAULIC DEVICE AND EVAPORATIVE SYSTEM WITH SUCH A HYDRAULIC DEVICE

CROSS REFERENCE TO RELATED APPLICATIONS

This application is a 371 national stage of PCT International Application No. PCT/CH2013/000119, filed Jul. 5, 2013, claiming priority of European patent application 12 006 951.3, filed Oct. 8, 2012, the contents of each of which are incorporated herein by reference in their entireties.

TECHNICAL FIELD

The invention relates to a hydraulic device and an evaporative system with such a hydraulic device according to the preambles of the independent claims. Such an evaporative system can for example be used in an air duct of an air conditioning system, in particular in an air duct of an air handling unit of an air conditioning system, for humidifying and/or for cooling room air.

BACKGROUND

The evaporative system typically comprises several banks of material to be wetted (also called: material banks), a water reservoir and a hydraulic device with a pump for moving the water from the water reservoir to the top of the material banks to wet the material. The banks of material to be wetted and the water reservoir are mounted inside the air duct of the air conditioning system. As air passes through the wetted material in the air duct, moisture is evaporated into the air flow. Mats of polyester fibres or glass fibres may for example be used as material, with one block of mats constituting one material bank.

FIG. 1 shows an evaporative system 1 according to the state of the art with material banks 2, a water reservoir 4 placed below the material banks 2 and a hydraulic device 5 in an air duct 3 of an air conditioning system. The material banks 2 extend in the transverse direction to the air flow. Water outlets of the hydraulic device are connected with the top of the material banks 2 via hoses/pipes 6. The hydraulic device 5 is connected to the water reservoir 4. The hydraulic device 5 typically consists of several single, separate components including among others a pump, tubing, an outlet valve for each material bank. The pump and the outlet valves are not individually adjustable such that water supply to the material banks cannot be varied apart from altering the states of the outlet valves or manually replacing mechanical flow restrictors. The valves can only be operated in one of two states: open or closed.

The hydraulic device 5 according to the state of the art needs to be mounted onto the water reservoir 4 inside the air duct 3. The hydraulic device 5 may thus block air flow in the air duct 3 leading to a decrease in energy efficacy. Furthermore, access limitations and/or legislation in some markets (such as Underwriters Laboratories UL 998) may require mounting the hydraulic device outside the air duct.

DISCLOSURE OF THE INVENTION

It is an object of the invention to provide a hydraulic device for an evaporative system that can be mounted internally or externally of an air duct of an air conditioning system, in particular of an air handling unit of an air conditioning system. It is a further object of the invention to provide a hydraulic device for an evaporative system that may be mounted such that air flow through an air duct of an air conditioning system is not impaired or only minimally impaired. It is a still further object of the invention to provide an evaporative system with such a hydraulic device.

In order to implement these and still further objects of the invention, which will become more readily apparent as the description proceeds, a hydraulic device for an evaporative system is provided, the hydraulic device comprising at least one pump and a housing with a water inlet and one or more water outlets, wherein the at least one pump is provided for pumping water through the one or more water outlets. A water tank is provided by the housing, preferably inside the housing. Regarding flow direction, the water tank is arranged between the water inlet and the one and more water outlets such that it connects the water inlet with the one or more water outlets. The connection may be indirect. The pump is mounted on the housing.

The housing with the water tank, the water inlet and the one or more water outlets is preferably formed integrally/as one piece which is preferentially made of plastics, in particular through moulding, especially injection moulding. Hence, the housing with the water tank, water inlet and the one or more water outlets is preferably given by a single moulding with the moulding preferentially also constituting connections at least between the water inlet, the water tank and the one or more water outlets such that no additional tubing/pipe work is required and the entire moulding can be mounted through flanging. The outer walls of the moulding may form the outer walls of the water tank. The at least one pump is mounted on this one piece, in particular this moulding.

By provision of the housing with the integrated water tank, the hydraulic device according to the invention advantageously is protected and easy to handle. It can equally well be arranged internally or externally of the air duct of an air conditioning system or its air handling unit. This makes the hydraulic device of the invention suitable for a wider range of markets than the hydraulic device according to the state of the art described above. Mounting the hydraulic device outside of the air duct has the advantage that no air flow is blocked leading to less pressure drop in the air duct and increased efficacy. Furthermore, through its compact design the hydraulic device according to the invention can be easily replaced, for example in the case of deterioration.

The evaporative system according to the invention comprises a water reservoir, one or more banks of material to be wetted and a hydraulic device according to the invention. The water reservoir is separate from the water tank of the hydraulic device. The one or more material banks are for placement in an air duct of an air conditioning system, in particular its air handling unit. The water inlet of the hydraulic device is connected to the water reservoir. One or water outlets of the hydraulic device are connected to the one or more material banks, in particular to the respective tops of the material banks with a water outlet being assigned to each material bank. Connections may be indirect. The water tank of the hydraulic device preferably has a smaller volume than the water reservoir.

As the hydraulic device of the invention comprises its own water tank, the water reservoir of the evaporative system can have a smaller volume and thus smaller dimensions than in the case of the known hydraulic device described above. With the evaporative system having a smaller water reservoir, the hydraulic device may be placed adjacent to the water reservoir in flow direction inside the air duct. Due to the integrated, compact design of the hydraulic device of the invention air flow through the air duct is not or only minimally impaired.

According to a preferred embodiment of the hydraulic device of the invention each of the one or more water outlets is provided with an output valve. There is preferentially only one pump for moving water from the water inlet via the water tank to the one or more outlet valves and thus to the material bank(s) (in a mounted state).

According to a more preferred embodiment of the hydraulic device of the invention each of the one or more water outlets is provided with an individually controllable pump. In this embodiment valves at the one or more water outlets are advantageously not required and may thus be omitted. As each water outlet is provided with its own individual pump, each individual pump may be of smaller effective power than the one and only pump employed in the known hydraulic device described above. For each material bank there is an individually controlled pump. Hence, water supply to each material bank can be individually adjusted. Arranging the pump(s) at the water outlet(s) of the housing of the hydraulic device also protects them against dirt and pollution. The pump(s) are in particular individually controllable in dependence on the outputs of a humidity sensor and/or a temperature sensor arranged in room(s) to be humidified and/or cooled. Preferably, the individual pump output is varied according to the maximum calculated irrigation water duty multiplied by the wash-over rate of the evaporative material.

BRIEF DESCRIPTION OF THE DRAWINGS

Further advantageous features and applications of the invention can be found in the dependent claims, as well as in the following description of the drawings illustrating the invention. In the drawings like reference signs designate the same or similar parts/components throughout the several figures of which:

FIG. 1 has been described in the introductory part of the description and it is referred thereto.

MODE(S) FOR CARRYING OUT THE INVENTION

Figure 2:
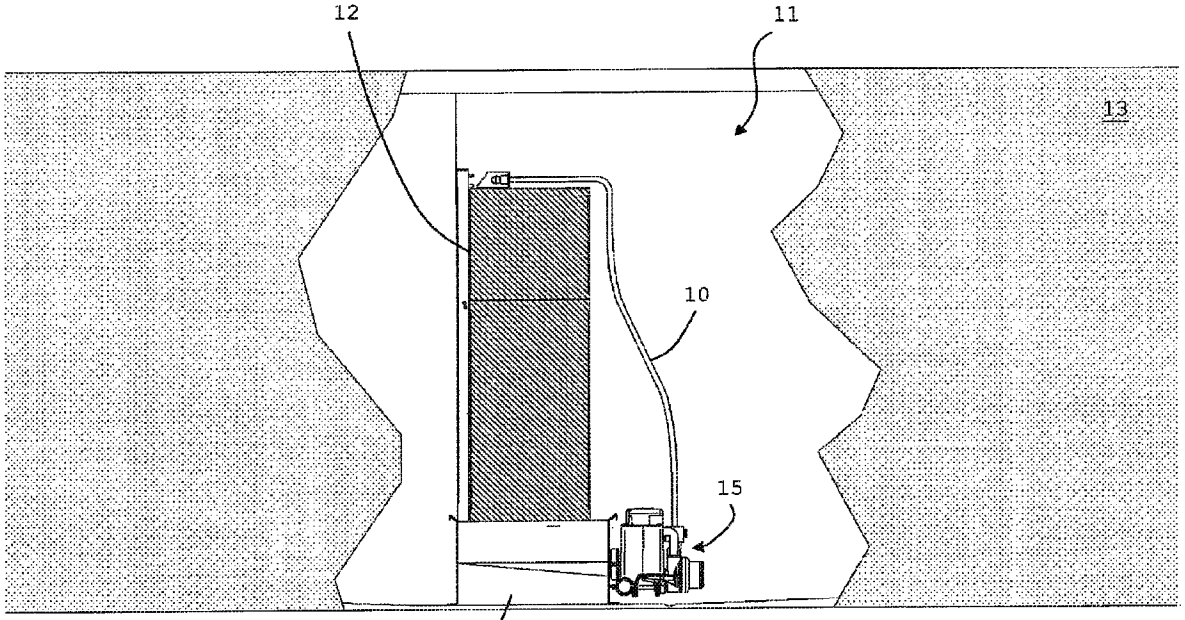
FIG. 2 shows an evaporative system of the invention with the hydraulic device arranged inside the air duct.
Figure 3:
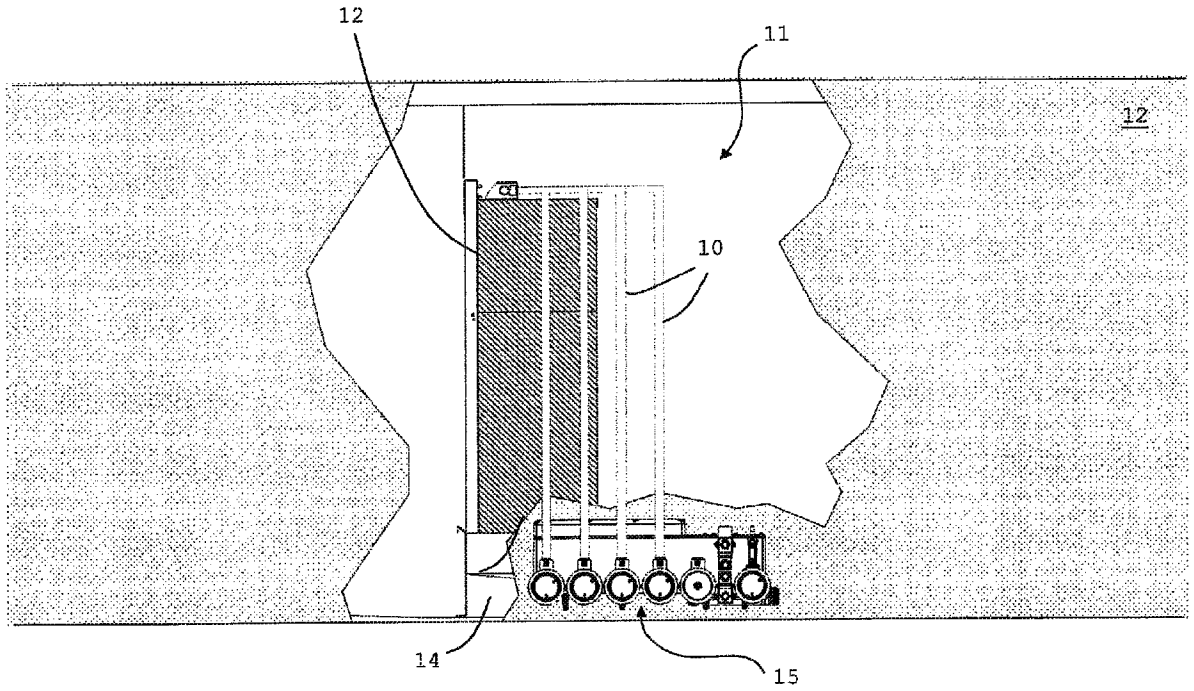
FIG. 3 shows an evaporative system of the invention with the hydraulic device arranged outside the air duct.

FIGS. 2 and 3 show an evaporative system 11 according to the invention. The evaporative system 11 comprises one or more material banks 12 with material to be wetted that extend in an air duct 13 of an air conditioning system, in particular its air handling unit, in a direction transverse to the direction of air flow. The material banks 12 are positioned on a water reservoir 14 that is also positioned inside the air duct 13. The water inlet of a hydraulic device 15 according to the invention is connected to the water reservoir 14 for water supply. One or more water outlets of the hydraulic device 15 are connected to the top of the material banks 12 via one or more hoses/pipes 10 for moving water to the material banks 12 to wet their material. In FIG. 3 four hoses/pipes 10 connected to four water outlets of the hydraulic device 15 are shown as example, each hose/pipe 10 being connected with the top of a material bank 12. The hydraulic device 15 is described below in detail with reference to FIGS. 4-8.

Due to the compact design of the hydraulic device 15 that is achieved through its housing with the integrated water tank, the hydraulic device 15 can be mounted in the air duct 13 next to the water reservoir 14 in air flow direction such that blocking of air flow can advantageously be avoided or at least minimized. This is depicted in FIG. 2. As shown in FIG. 3, the hydraulic device 15 according to the invention can also be mounted outside of the air duct 13 which—apart from not blocking air flow—has the further advantage that the hydraulic device can be easily reached, for example for replacement. In FIG. 3, the side wall of the air duct 13, onto which the hydraulic device 15 is mounted, has been shown partly broken away such that the material banks 12 and the water tank can be seen. There are exemplarily four hoses/pipes 10 shown that connect the hydraulic device with four adjacent material banks 12.

Figure 1:
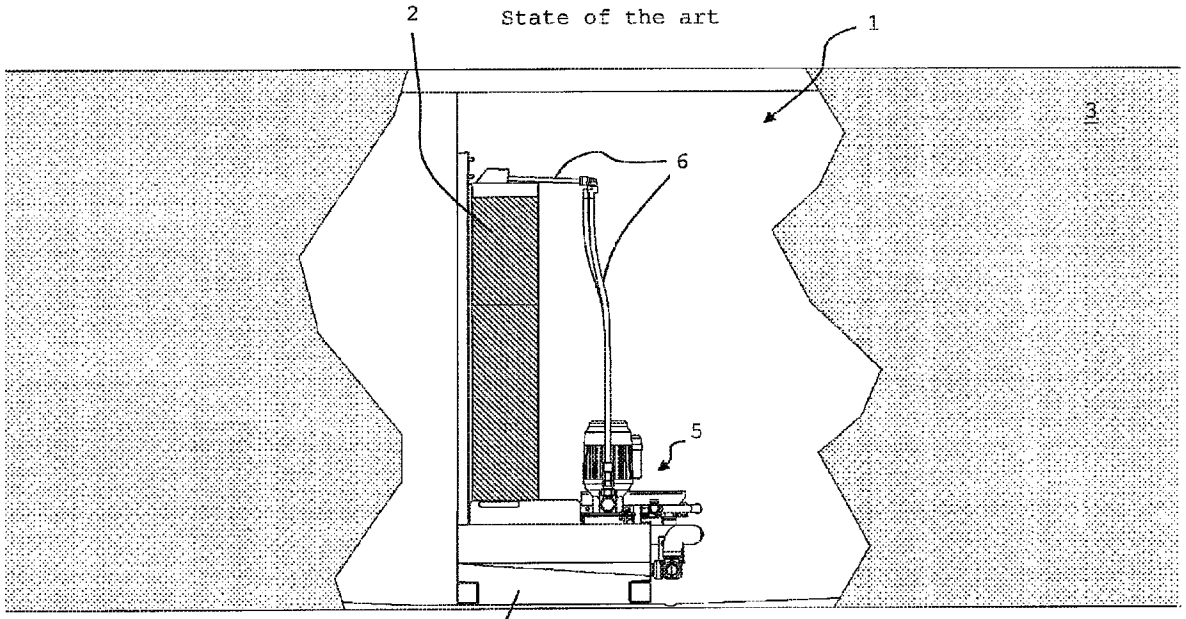
FIG. 1 shows an evaporative system according to the state of the art.

Thus, the hydraulic device 15 of the invention is more flexible in use than the known hydraulic device 5 depicted in FIG. 1. The hydraulic device 15 of the invention can also be used in markets or with air conditioning systems that restrict mounting to the outside of the air duct. Furthermore, as can be seen from a comparison of FIG. 1 with FIGS. 2 and 3, due to the hydraulic device 15 having its own water tank, the water reservoir 14 can be much smaller in volume than the water reservoir 4 that is used together with the hydraulic device 5 of the state of the art. Thus, with the hydraulic device 15 of the invention much less installation space is required for the water reservoir 14.

The evaporative system 11 of the invention can be equally well used with the hydraulic device 55 shown in and described below with reference to FIGS. 9-14, yielding the basically the same advantages as with the hydraulic device 15. Also the hydraulic device 55 may be mounted internally or externally of an air duct.

Figure 4:
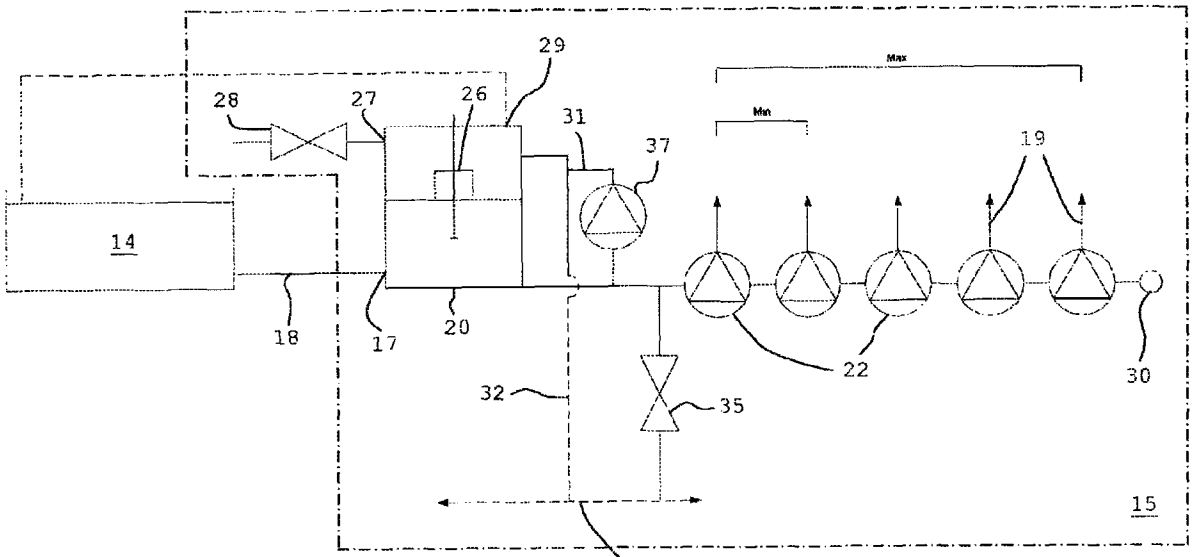
FIG. 4 shows a schematic diagram of a first embodiment of the hydraulic device of the invention and a water reservoir.

FIGS. 4 to 8 relate to the first preferred embodiment 15 of a hydraulic device according to the invention that was also depicted in FIGS. 2 and 3. FIG. 4 shows a schematic diagram of the hydraulic device 15 that is connected to the water reservoir 14 of the evaporative system 11. FIGS. 5-8 show the hydraulic device 15 in various views.

The hydraulic device 15 has a housing 16 with a water inlet 17 for connection with the water reservoir 14. The water inlet 17 may be connected to the water reservoir 14 via a spigot 18 of the water reservoir 14. If the hydraulic device 15 shall be connected to the water reservoir 14 inside the air duct 13 as depicted in FIG. 2, the water inlet 17 is directly pushed onto the spigot 18, forming a push fit connection. If the hydraulic device 15 shall be placed outside the air duct 13, as shown in FIG. 3, a pipe is run from the spigot 18 externally to the air duct for connection with the hydraulic device 15. The spigot 18 may be sealed with internal O-rings (not shown).

The housing 16 may be provided with brackets 38 extending downwards for mounting the hydraulic device 15 onto the water reservoir 14 of the evaporative system 11. For lateral mounting on the water reservoir 15 or on the outside of a wall of the air duct 13 brackets extending laterally may be provided instead or additionally.

The housing 16 has exemplarily five water outlets 19, each water outlet 19 being connectable to a hose or pipe 10 for supplying water to a material bank 12. More or less than the depicted number of water outlets 19 can be provided depending on the particular application.

The housing 16 furthermore comprises a water tank 20 that is provided by the housing 16 and connects the water inlet 17 with the water outlets 19. Moreover, the housing 16 may comprise a compartment 21 for receiving an electrical distribution box (not shown) to be connected to an external control unit (not shown), for example for controlling the hydraulic device 15 in response to measured humidity and/or room temperature values. Electrical or electrically controllable components such as sensors and valves, in particular the water level sensor 26, the conductivity sensor 30, the inlet valve 28 and the drain valve 35 described below, are all wired to the electrical distribution box in compartment 21 which makes installation of the hydraulic device 15 also electrically quick and simple, as for controlling these electrical components the external control unit only has to be connected to the electrical distribution box. The electrical distribution box is designed to conform especially with UL (Underwriters Laboratories) 998 and/or UL508A and CE (Conformité Européenne) requirements.

Figure 5:
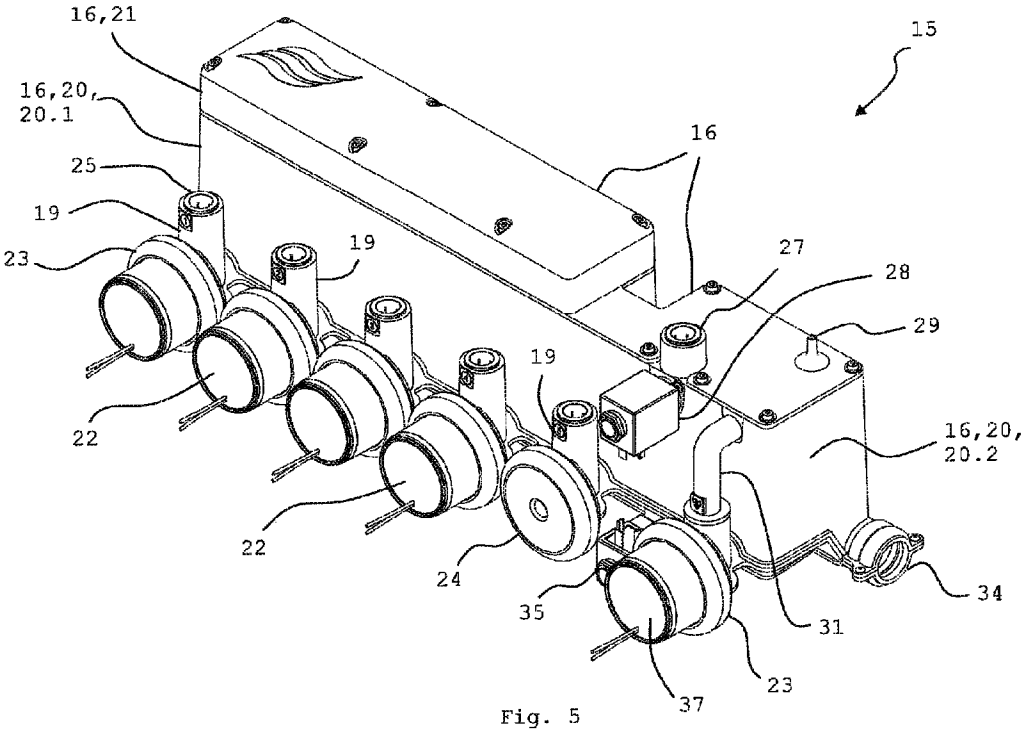
FIG. 5 shows a perspective front view of the first embodiment of the hydraulic device of the invention.
Figure 6:
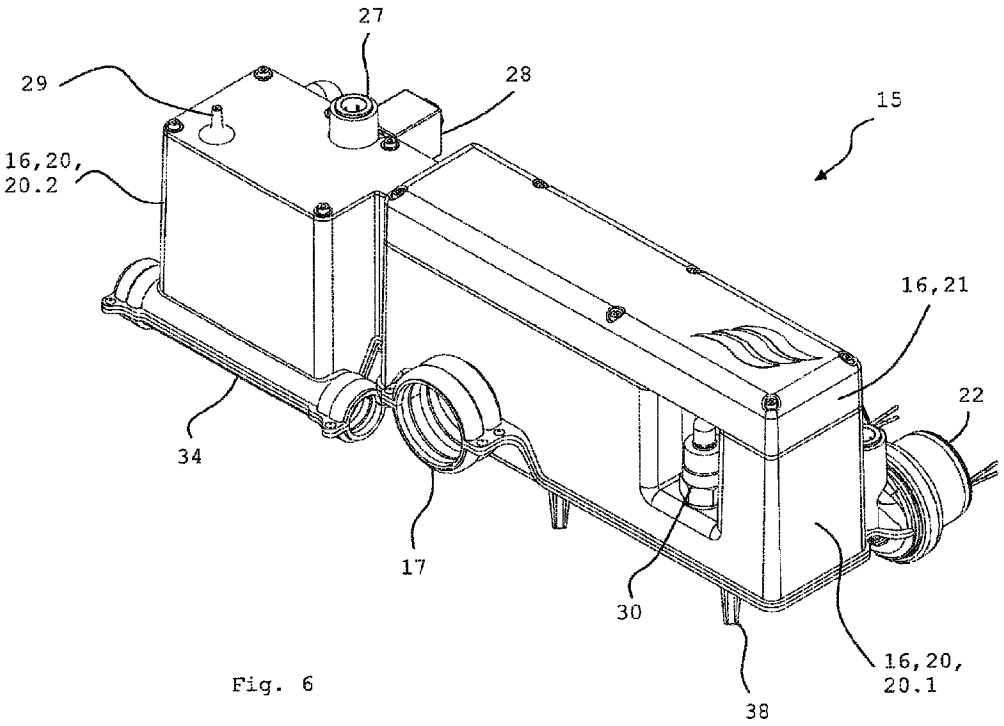
FIG. 6 shows a perspective rear view of the first embodiment of the hydraulic device of the invention.
Figure 7:
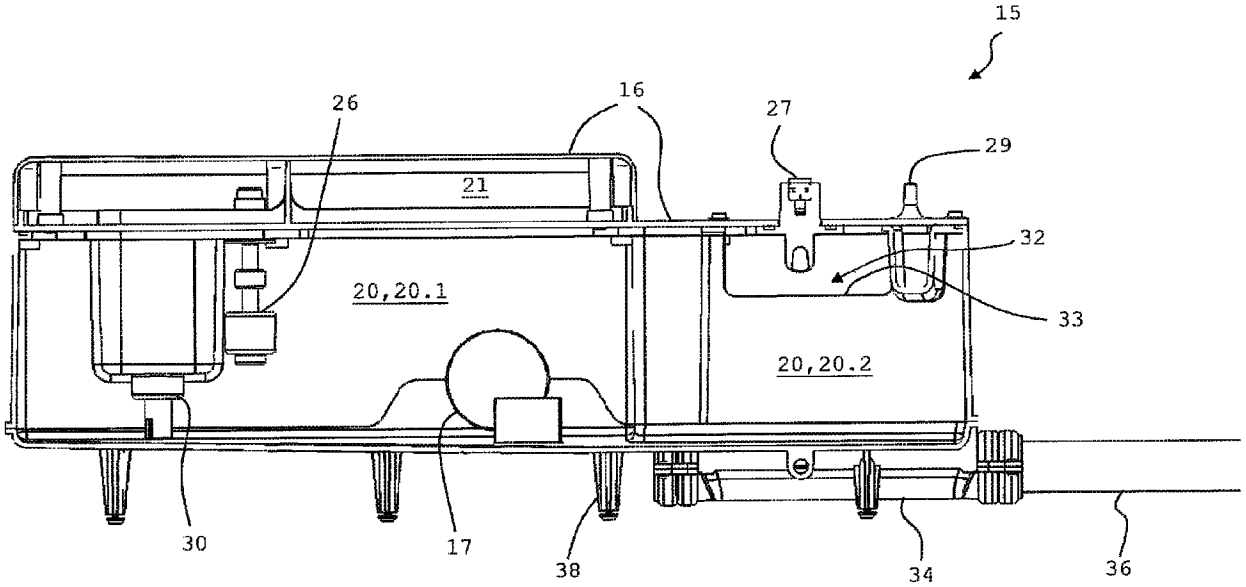
FIG. 7 shows a longitudinal cut through the first embodiment of the invention.

Preferably, the housing 16 with the water inlet 17 and the water outlets 19, the water tank 20 and, if applicable, the compartment 21, is formed as one piece, in particular as one plastic moulding, as depicted in FIGS. 5-7. The outer walls of the moulding preferentially form the outer walls of the water tank 20.

An individually controllable pump 22 is arranged at each water outlet 19 that is to be connected to a material bank 12 for moving water from the water tank 20 to the respective material bank 12 via the water outlets 19. The pumps 22 are preferably connected to the water outlets 19 by means of retaining rings 23 that also provide sealing. The water outlets 19 that are not needed are blanked off by a blanking plug 24 that is placed onto the pump seating. The water outlets 19 are preferably each provided with a push fit fitting 25 for quick installation of hoses/pipes 10 onto them for connection with the material banks 12.

The flow rate of the individually controllable pumps 22 is especially controlled by voltage variation through pulse width modulation. The pumps 22 preferably consist of corrosion resistant material that is suitable for all conceivable water qualities. The pump rotor (not shown) is preferentially mounted such that it can tilt to avoid blockage by small debris.

By means of the individually controllable pumps 22 each material bank 12 of the evaporative system 11 can be wetted individually. The pumps 22 are in particular controlled in dependence on the difference between humidification and/or cooling/temperature demands and measured humidification and/or temperature levels/values. A provided control unit can individually switch the pumps 22 on or off and, moreover, control the pumps 22 individually depending on this difference between demands and measured levels/values.

Employing individually controllable pumps 22 in the hydraulic device 15 makes the evaporative system 11 much more energy efficient, allowing accurate control of its operation with respect to demands. Furthermore, in that several pumps 22 are provided the hydraulic device 15 has built in redundancy, i.e. an evaporative system 11 with the hydraulic device 15 will still function—albeit with reduced output—even if one of its pumps 22 fails. This is a further advantage over systems with one single pump.

The water tank 20 is preferably provided with a water level sensor 26 to prevent significant fluctuations of the water level in the water tank 20 (and thus in the housing 16; see FIGS. 4 and 7) and to ensure that the water level in the water tank 20 basically corresponds to the water level in the water reservoir 14. As water level sensor 26 a water level float switch, in particular a four level float switch, may be used. The four level float switch 26 detects a 'low water level' (with the water level being equal to or below a predefined lower threshold), 'normal operation' (with the water level lying between the lower and an upper threshold) and 'high water level' (the water level being equal to or above a predefined upper threshold). The output of the water level sensor 26 can be transmitted to the external control unit via the electrical distribution box contained in the compartment 21, and evaluated by the control unit. Alternatively, the water level sensor 26 may be realized by an appropriate analogue sensor.

The water tank 20 is preferably provided with a fresh water inlet 27 with an inlet valve 28, in particular an inlet solenoid valve, assigned to it. The fresh water inlet 27 may be defined by the housing 16. The inlet valve 28 is electrically connected with the electrical distribution box in the compartment 21. Via the electrical distribution box the inlet valve 28 may be controlled by the external control unit.

If the water level in the water tank 20 is determined to be a 'low water level' then the control unit preferably opens the inlet valve 28 such that fresh water is supplied to the water tank 20 via the fresh water inlet 27. The fresh water is supplied from an external water supply which may be the water reservoir 14 of the evaporative system 11. After water levels corresponding to 'normal operation' have been reached the control unit closes the inlet valve 28. Furthermore, the control unit can execute a low water level alarm and stop the pumps 22 to prevent them running dry. The water level may for example sink due to evaporation. If the water level is too high, i.e. the water level sensor 26 measures a 'high water level', the control unit preferably raises a high water level alarm to prevent overflow.

As shown in FIGS. 5-7 the water tank 20 may comprise two (or more) connected water tank parts 20.1, 20.2 for damping reasons. The first water tank part 20.1 is preferably directly connected with the water inlet 17. The first water tank part 20.1 is preferably also closer to the water outlets 19. I.e. the second water tank part 20.2 is preferably arranged in parallel to the first water tank part 20.1 with respect to the water flow. The water level sensor 26 is preferably placed in the first water tank part 20.1, whereas the fresh water inlet 27 is preferably assigned to the second water tank part 20.2 to avoid water disturbances in the first water tank part 20.1 when fresh water is introduced through the fresh water inlet 27.

For external application of the hydraulic device 15, i.e. for application outside the air duct 13, the water tank 20, in particular the second water tank part 20.2, is provided with a pressure equalization point 29 that is connectable to the water reservoir 14 to ensure that the water level in the water tank 20 (and thus inside the housing 16) corresponds to the water level in the water reservoir 14 placed inside the air duct 13. The pressure equalization point 29 is preferably designed as pressure equalization spigot.

The water tank 20, in particular the second water tank part 20.2, is provided with a water drain 31 for draining water if required. The water drain 31 may be provided with a drain valve 35, in particular with a drain solenoid valve. The drain valve 35 is electrically connected to the electrical distribution box in the compartment 21. Via the electrical distribution box the drain valve 35 may be controlled by the external control unit.

Furthermore, the water drain 31 is preferably provided with a drain pump 37 for faster draining, the drain pump 37 being fitted to the water drain 31 by means of a retaining ring 23. The drain pump 37 is controllable by the control unit. The water drain 31 is connected with a drain pipe 34, onto which drain pipe work 36 may be installed at its left hand side or at its right hand side as indicated by the double arrow in FIG. 4. In FIG. 7 the drain pipe work 36 is connected to the right hand side of the drain pipe 34. At its ends the drain pipe 34 is preferably provided with push fit connections for fitting the drain pipe work 36. The end of the drain pipe 34, onto which no drain pipe work 36 is fitted, is sealed with a blanking plug. The drain pipe 34 preferably forms part of the moulding that constitutes the housing 16 with the water tank 20.

Faster draining by means of the drain pump 37 is particularly useful on hydraulic devices 15 with large water tanks 20 that hold high volumes of water. Using a pumped water drain 31 instead of a gravity drain has furthermore the advantage that more particulate matter is removed from the re-circulated water. In addition to the pumped water drain 31 a gravity drain may be used to ensure full emptying of the water tank 20 once the water reaches a specific low level.

Furthermore, a conductivity sensor 30 is provided for measuring electrical conductivity of the water in the water tank 20. The conductivity sensor 30 is preferably located in the first water tank part 20.1. Measuring electrical conductivity provides a fast measure for determining water hardness. The higher the measured electrical conductivity, the higher the water hardness is. High water hardness is indicative of high mineral content which may lead to breakdown of the hydraulic device 15.

The output of the conductivity sensor 30 is fed to the control unit via the electrical distribution box located in the compartment 21. If the control unit finds that the measured electrical conductivity exceeds a predefined conductivity threshold, the control unit will open the drain valve 35 of the water drain 31 and replace the drained water with fresh water by opening the inlet valve 28 as described above. The conductivity sensor 30 is preferably provided with (water) temperature compensation to ensure accurate measurements. The housing 16 is preferably formed such that it can house the conductivity sensor 30.

Figure 8:
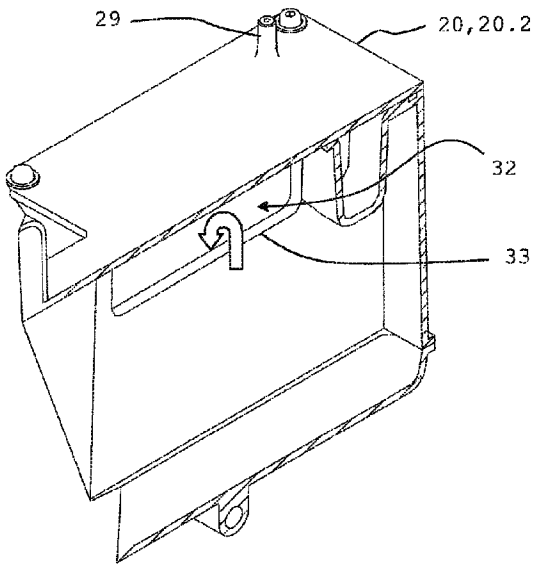
FIG. 8 shows an overflow of the first embodiment of the invention.

To protect the hydraulic device 15 from flooding, the water tank 20—and hence the housing 16—preferably includes an integrated overflow 32 (see FIGS. 4, 7 and 8). The overflow 32 is preferentially given by an internal wall 33 of the water tank 20 that is lower than the outer walls of the water tank 20. The internal wall 33 is preferred to be provided in the second water tank part 20.2 for damping reasons. The arrow in FIG. 7 indicates the direction the water flows in case the water level rises above the internal wall 33. Water bypassing the overflow 32 leaves the hydraulic device 15 via the drain pipe 34. As the overflow 32 is integrated into the housing 16, and preferably forms part of the same moulding as the housing 16, only a single drain pipe 34/a single drain connection is required, reducing the complexity and cost of installation.

Figure 9:
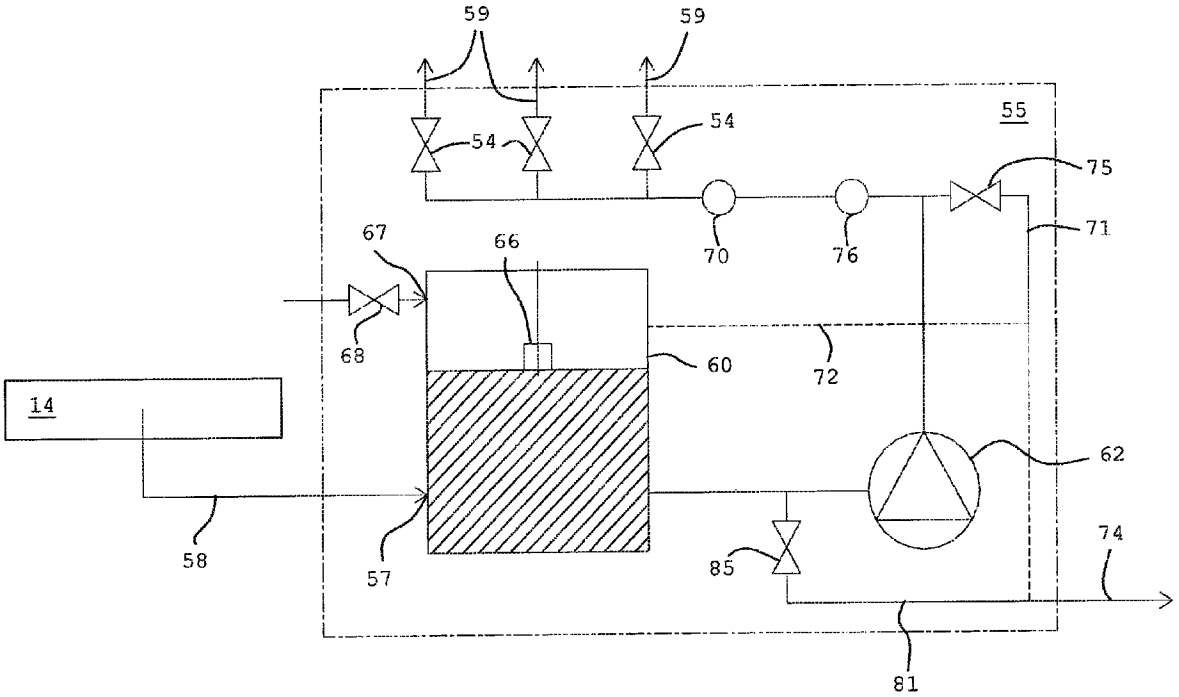
FIG. 9 shows a schematic diagram of a second embodiment of the hydraulic device of the invention and a water reservoir.
Figure 10:
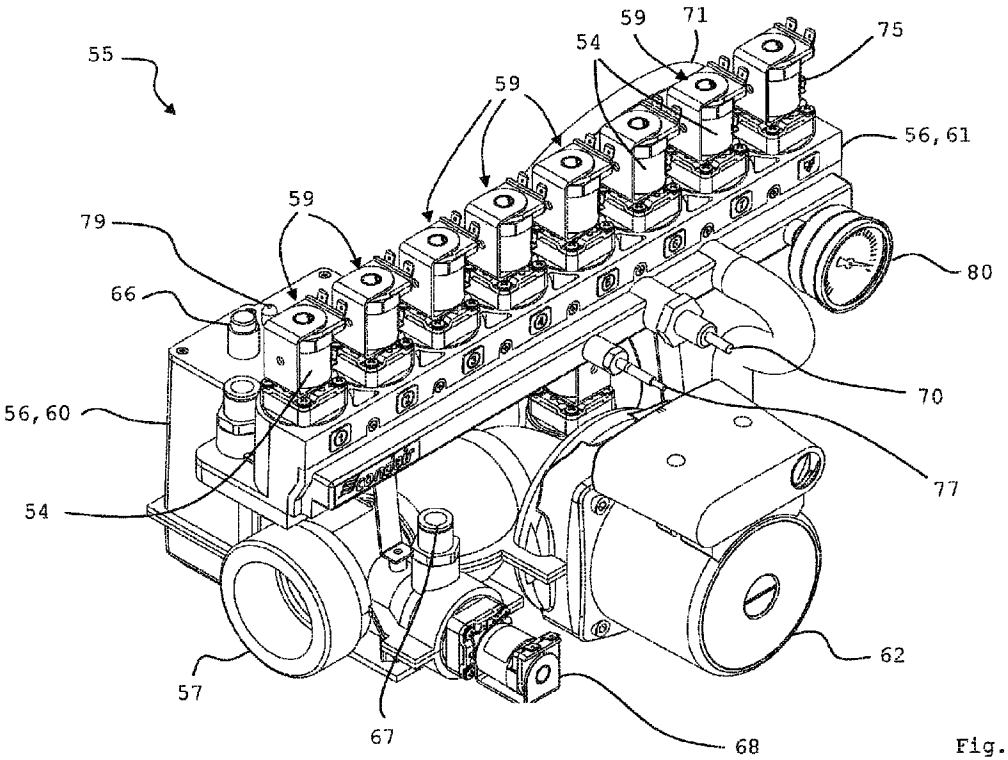
FIG. 10 shows a perspective front view of the second embodiment of the hydraulic device of the invention.
Figure 11:
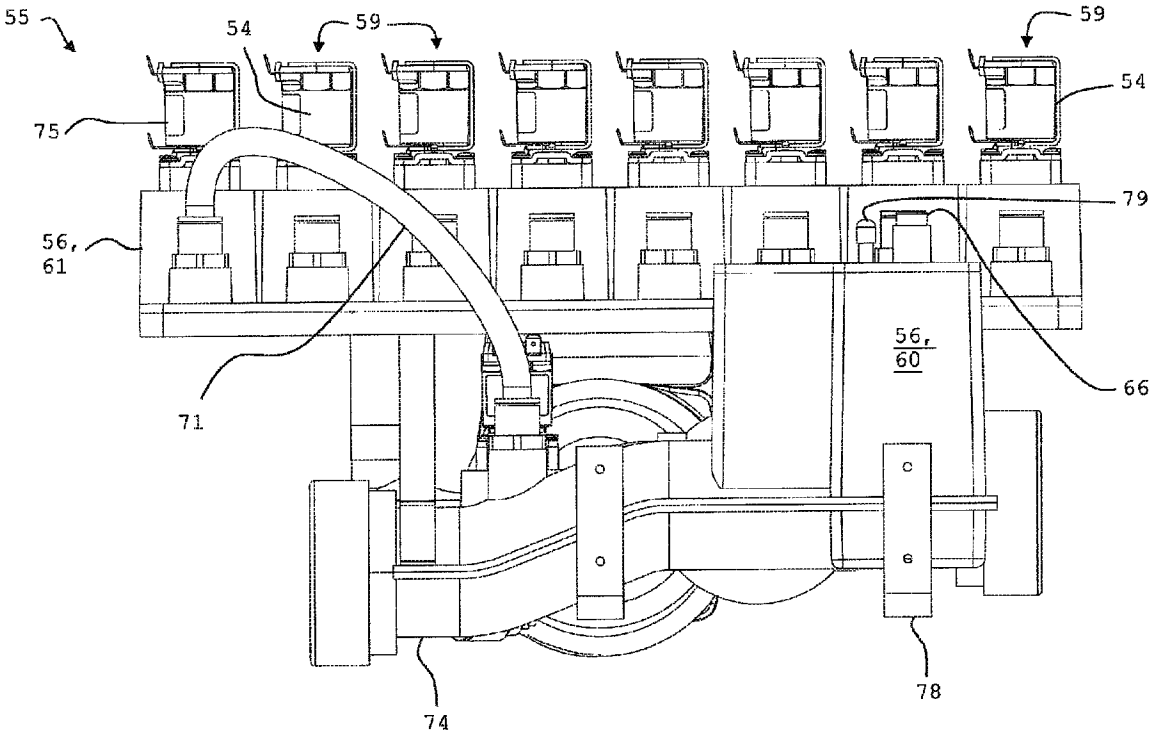
FIG. 11 shows a rear view of the second embodiment of the hydraulic device of the invention.
Figure 12:
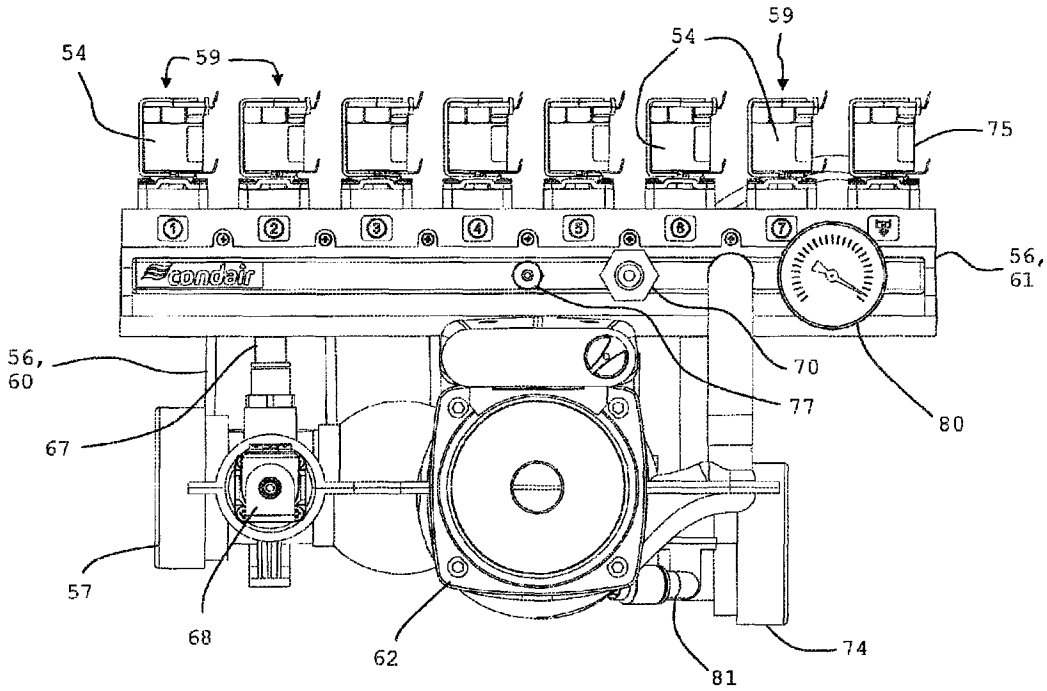
FIG. 12 shows a front view of the second embodiment of the hydraulic device of the invention.
Figure 13:
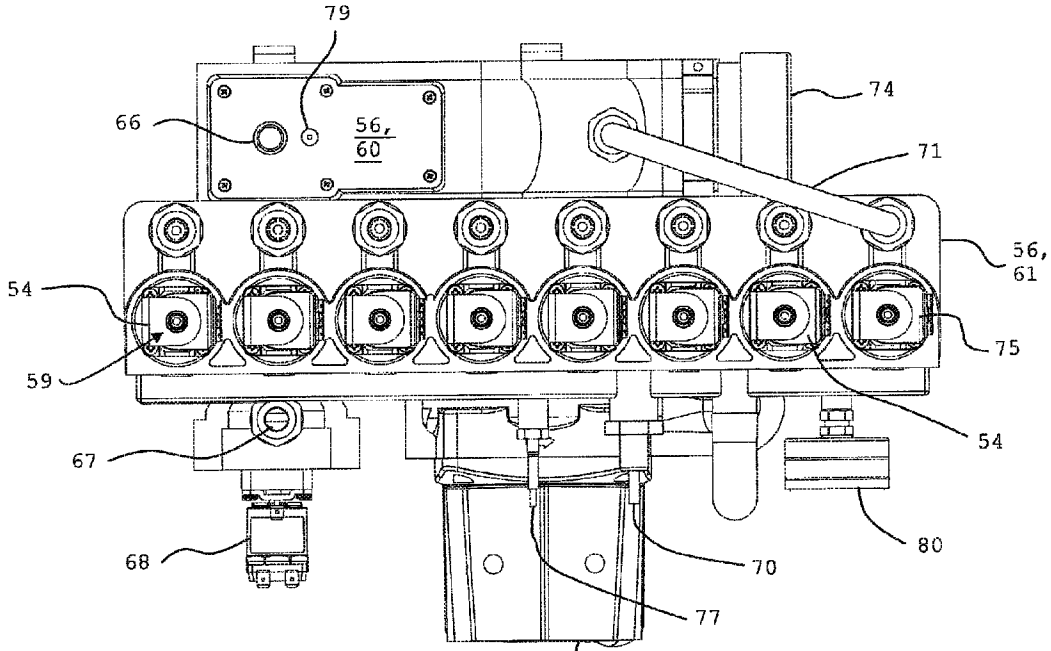
FIG. 13 shows a top view of the second embodiment of the hydraulic device of the invention.

FIGS. 9 to 14 relate to a second embodiment 55 of the hydraulic device according to the invention. FIG. 9 shows a schematic diagram of the hydraulic device 55 that is connected to the water reservoir 14 of the evaporative system 11. FIGS. 10-14 show the hydraulic device 55 in various views.

The hydraulic device 55 comprises a housing 56 with a water inlet 57 that may be connected to the water reservoir 14 for example by means of a tank spigot 58 in the same manner as described for the first embodiment 15 for internal or external application. The tank spigot 58 may be sealed with O-rings.

The housing 56 has exemplarily seven (FIGS. 10-13) or three water outlets 59 (FIG. 9). Each water outlet 59 can be connected to a material bank 12 to wet by means of a hose or pipe 10. Hence, each water outlet 59 independently wets a material bank 12. The number of water outlets 59 can be smaller or greater than seven or three, respectively depending on the particular application. If the number of water outlets 59 exceeds the number of material banks 12, the water outlets 59 that are not needed are blanked off by blanking plugs.

The housing 56 furthermore comprises a water tank 60 connecting the water inlet 57 with the water outlets 59. Connections may be indirect. The housing 56 with the water inlet 57, the water outlets 59 and the water tank 60 is preferably formed as one piece, in particular as a moulding, for example through injection moulding, with the material of the moulding preferentially being plastics. Moreover, the housing 56 preferably comprises a distribution manifold 61 downstream of the water tank 60 for dividing the water coming from the water tank 60 between the water outlets 59.

Each water outlet 59 is provided with an outlet valve 54 that can be switched between an open and a closed state by an external control unit to control the water output of the hydraulic device 55 in dependence on humidification and/or cooling demands.

Furthermore, a single pump 62 is provided by which water from the water tank 60 is moved via the distribution manifold 61 to the water outlets 59 for feeding of the material banks 12. Hence, a single pump 62 is provided for all water outlets 59. The pump 62 is preferably controllable by the external control unit. The pump 62 is mounted on the housing 56 that may be given by a moulding.

The water tank 60 is preferably provided with a water level sensor 66, especially a four level water level float, to prevent significant fluctuations in water level. The water level sensor 66 can be connected—directly or indirectly—to the external control unit. The water level sensor 66 corresponds to the water level sensor 26 described above in connection with the first embodiment 15 and what has been said with respect to the water level sensor 26 of the first embodiment 15 shall apply to the water level sensor 66 of the second embodiment 55. Alternatively, an appropriate analogue sensor may be used as water level sensor 66.

The fresh water inlet 27 with the inlet valve 28 of the first embodiment 15 basically corresponds to a preferably provided fresh water inlet 67 of the second embodiment 55 that may form part of the housing 56, the fresh water inlet 67 being provided with an inlet valve 68, in particular an inlet solenoid valve. By way of the fresh water inlet 67 fresh water can be introduced into the water tank 60 if water level becomes too low as has been described in connection with the first embodiment 15.

The water tank 60 is moreover preferably provided with a water drain 71 that is connected to the distribution manifold 61 and, thus, via the distribution manifold 61 to the water tank 60. Preferably, a drain valve 75 is assigned to the water drain, the drain valve 75 especially being a drain solenoid valve. A further water drain 81 with a drain valve 85, in particular a drain solenoid valve, may be connected to the water tank 60 directly. The water drain 71 is preferably coupled with a drain pump for faster draining. The water drain 81 may be equally well coupled with a drain pump. With drain pumps faster draining is achieved which is particularly useful on large hydraulic devices 55 whose water tanks 60 can hold high volumes of water. Furthermore, pumping water to drain removes more particulate matter. Alternatively, the water drain 71 and/or the further water drain 81 may be gravity drains. The water drain 71 and, if provided, the water drain 81 are connected to a drain pipe 74 that is preferably formed by the housing 56, that may be given by a moulding. Drain pipe work may be installed onto the drain pipe 74. When draining is required the control unit will close the outlet valves 54 and open the drain valve 75 and/or the drain valve 85, allowing water to bypass to the water drain 71 and/or the water drain 81.

A conductivity sensor 70 for measuring electrical conductivity of the water is preferably provided, the conductivity sensor 70 preferably comprising (water) temperature monitoring and compensation 76 to ensure reading accuracy. The conductivity sensor 70 corresponds to the conductivity sensor 30 that has been described in connection with the first embodiment 15 and it is referred thereto.

The conductivity sensor 70 is preferably assigned to the distribution manifold 61, but may also be assigned to the water tank 60 instead. If the measured electrical conductivity lies above a predefined threshold the control unit opens the drain valve 75 of the water drain 71 and/or the drain valve 85 of the water drain 81 to drain water via the drain pipe 74. The control unit furthermore opens the inlet valve 68 of the fresh water inlet 67 to replace the drained water with fresh water. By monitoring conductivity excessive drainage can be prevented. The housing 56 preferably provides a casing for receiving the conductivity sensor 70, the housing 56 preferably being given by a moulding.

Figure 14:
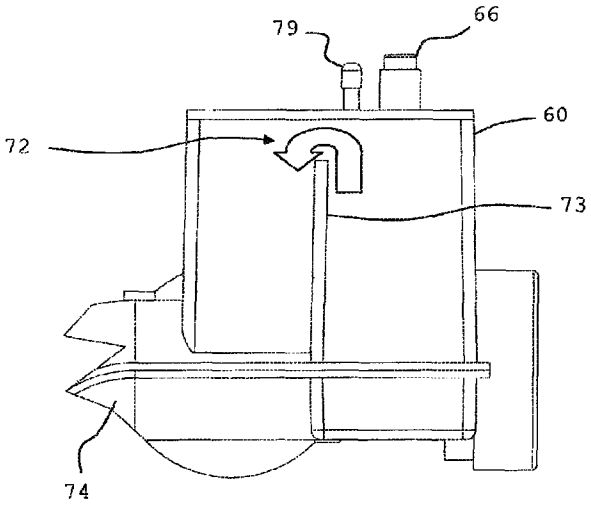
FIG. 14 shows an overflow of the second embodiment of the invention.

As with the first embodiment 15, the water tank 60 preferably comprises an overflow 72 that is in particular realized by an internal wall 73 of the water tank 60, the internal wall 73 being of lower height than the outer walls of the water tank 60 (see FIGS. 9 and 14). The overflow 72 preferably forms part of the moulding that defines the water tank 60 among others. The arrow in FIG. 14 indicates the direction the water flows in case the water level in the water tank 60 rises above the internal wall 73. The water that bypasses the internal wall 73 leaves the hydraulic device 55 by way of the drain pipe 74.

The housing 56 that is preferably given by a moulding may comprise an integrated strainer that is designed to stop debris from circulating in the hydraulic device 55 and from getting into its parts/components which might cause them to fail. The strainer can be removed and replaced after cleaning, making it a serviceable part of the hydraulic device 55. The first embodiment 15 described above may be provided with a similar strainer.

Furthermore, a pressure switch 77 may be provided at the housing 56 downstream of the pump 62, in particular at the distribution manifold 61, to monitor pump operation and to detect a faulty pump. The distribution manifold 61 may also be provided with a pressure gauge 80.

Moreover, as with the first embodiment 15, the water tank 60 is preferably provided with a pressure equalization point 79 for external application of the hydraulic device 55, i.e. in case the hydraulic device 55 shall be mounted outside of the air duct 13. The pressure equalization point 79 may be designed as pressure equalization spigot. The pressure equalization point 79 shall be connected with the water reservoir 14 of the evaporative system 11 to ensure that the water level in the water tank 60 corresponds to the water level in the water reservoir 14 placed inside the air duct 13.

The hydraulic device 55 is preferably provided with brackets 78 for mounting the hydraulic device 55 onto the water reservoir 14 or onto the outside of a wall of the air duct 13.

It is to be understood that while certain embodiments of the present invention have been illustrated and described herein, it is not to be limited to the specific embodiments described and shown.

The invention claimed is:

1. Hydraulic device for an evaporative system, comprising at least one pump, having a housing with a water inlet and one or more water outlets, wherein the at least one pump is mounted on the housing and a water tank is provided by the housing, the water tank being arranged between the water inlet and the one or more water outlets, wherein the at least one pump is provided for pumping water through the one or more water outlets, and wherein each of the one or more water outlets is assigned an individually controllable pump for pumping water through the respective water outlet.

2. Hydraulic device according to claim 1, wherein the housing with the water tank is formed as one piece.

3. Hydraulic device according to claim 1, wherein the hydraulic device comprises no valves at its one or more water outlets.

4. Hydraulic device according to claim 1, wherein the water tank is provided with a water level sensor.

5. Hydraulic device according to claim 2, wherein the housing with the water tank is formed as a moulding.

6. Hydraulic device for an evaporative system, comprising at least one pump, having a housing with a water inlet and one or more water outlets, wherein the at least one pump is mounted on the housing and a water tank is provided by the housing, the water tank being arranged between the water inlet and the one or more water outlets, wherein the at least one pump is provided for pumping water through the one or more water outlets, and wherein each of the one or more water outlets is provided with an outlet valve.

7. Hydraulic device according to claim 6, wherein just one pump is provided for moving the water from the water inlet to the one or more water outlets.

8. Hydraulic device according to claim 6, wherein the housing with the water tank is formed as one piece.

9. Hydraulic device according to claim 8, wherein the housing with the water tank is formed as a moulding.

10. Hydraulic device according to claim 6, wherein the water tank is provided with a water level sensor.

11. Hydraulic device for an evaporative system, comprising at least one pump, having a housing with a water inlet and one or more water outlets, wherein the at least one pump is mounted on the housing and a water tank is provided by the housing, the water tank being arranged between the water inlet and the one or more water outlets, wherein the at least one pump is provided for pumping water through the one or more water outlets, and wherein the water tank is provided with an overflow.

12. Hydraulic device for an evaporative system, comprising at least one pump, having a housing with a water inlet and one or more water outlets, wherein the at least one pump is mounted on the housing and a water tank is provided by the housing, the water tank being arranged between the water inlet and the one or more water outlets, wherein the at least one pump is provided for pumping water through the one or more water outlets, and wherein a conductivity sensor is provided.

13. Hydraulic device for an evaporative system, comprising at least one pump, having a housing with a water inlet and one or more water outlets, wherein the at least one pump is mounted on the housing and a water tank is provided by the housing, the water tank being arranged between the water inlet and the one or more water outlets, wherein the at least one pump is provided for pumping water through the one or more water outlets, and wherein the water tank is provided with a water drain to which a drain pump is assigned.

14. Evaporative system with a water reservoir, one or more banks of material to be wetted and a hydraulic device for an evaporative system, comprising at least one pump, having a housing with a water inlet and one or more water outlets, wherein the at least one pump is mounted on the housing and a water tank is provided by the housing, the water tank being arranged between the water inlet and the one or more water outlets, wherein the at least one pump is provided for pumping water through the one or more water outlets, wherein the water inlet of the hydraulic device is connected to the water reservoir, the water reservoir being separate from the water tank of the hydraulic device, and wherein one or more water outlets of the hydraulic device are connected to the one or more banks of material, with a water outlet being assigned to each bank of material.

* * * * *